US006983577B2

(12) United States Patent
Hartness et al.

(10) Patent No.: US 6,983,577 B2
(45) Date of Patent: Jan. 10, 2006

(54) CIRCULAR MOTION FILLING MACHINE FOR PROCESSING PARALLEL ROWS OF CONTAINERS AND METHOD

(75) Inventors: Thomas Patterson Hartness, Greenville, SC (US); Richard M. Wiernicki, Roebuck, SC (US); Robert Leslie Dillard, Easley, SC (US); David Lee Scott, Greenville, SC (US)

(73) Assignee: Hartness International, Inc., Greenville, SC (US)

( * ) Notice: Subject to any disclaimer, the term of this patent is extended or adjusted under 35 U.S.C. 154(b) by 70 days.

(21) Appl. No.: 10/274,656

(22) Filed: Oct. 21, 2002

(65) Prior Publication Data

US 2003/0037514 A1 Feb. 27, 2003

Related U.S. Application Data

(63) Continuation-in-part of application No. 09/418,619, filed on Oct. 15, 1999, now Pat. No. 6,729,103.

(51) Int. Cl.
*B65B 7/28* (2006.01)
*B65B 5/10* (2006.01)

(52) U.S. Cl. ..... 53/471; 53/251; 53/278; 53/299; 53/475; 53/485; 141/145; 141/237; 141/250

(58) Field of Classification Search ..... 53/250, 53/251, 253, 276, 277, 278, 282, 287, 299, 53/467, 471, 475, 485; 141/59, 145, 146, 141/177, 178, 179, 181, 182, 234, 235, 237, 141/250, 251, 259, 260
See application file for complete search history.

(56) References Cited

U.S. PATENT DOCUMENTS

| | | | | | |
|---|---|---|---|---|---|
| 989,546 | A | * | 4/1911 | Jensen | 141/117 |
| 1,072,290 | A | * | 9/1913 | Wood et al. | 141/177 |
| 1,481,259 | A | | 1/1924 | Harrison | |
| 1,538,406 | A | | 5/1925 | McCarty et al. | |
| 1,583,767 | A | | 5/1926 | Akins et al. | |
| 1,636,421 | A | | 7/1927 | Knott | |
| 1,933,551 | A | * | 11/1933 | Gaynor | 53/282 |
| 1,942,885 | A | * | 1/1934 | Tevander | 53/282 |
| 2,277,688 | A | | 3/1942 | Cattonar et al. | |
| 2,350,692 | A | | 6/1944 | Milek | |
| 2,730,279 | A | | 11/1951 | Enock | |

(Continued)

FOREIGN PATENT DOCUMENTS

DE 4216721 A1 * 11/1993

OTHER PUBLICATIONS

Hartness, U.S. Patent App. No. US 2002/0150458; Packing And Unpacking Machine, Oct. 17, 2002.
Hartness, U.S. Patent App. No. US 2003/0009994; Continuous Circular Motion Case Packing and Closure Apparatus And method, Jan. 16,2003.

(Continued)

*Primary Examiner*—Louis Huynh
(74) *Attorney, Agent, or Firm*—Dority & Manning, P.A.

(57) ABSTRACT

An apparatus and method is disclosed for processing containers or other articles by using continuous rotation of processing heads in a circular path about a single vertical axis and controlling the processing heads to independently rotate about a swivel axis causing them to move in a straight-line path while the heads are lowered to engage a group of containers or articles arranged in parallel rows. In this manner, a higher production apparatus and method are provided which is simpler, more reliable, requires less floor space, and easy to reconfigure for different applications.

44 Claims, 10 Drawing Sheets

U.S. PATENT DOCUMENTS 2,671,588 A * 3/1954 Vogt ..... 141/237
2,760,316 A 8/1956 Okulitch et al.
2,890,553 A 6/1959 Day et al.
2,921,425 A 1/1960 Seval
2,928,693 A 3/1960 Cannon, Jr.
3,012,811 A 12/1961 Sandrock
3,505,787 A 4/1970 Tiews
3,553,927 A 1/1971 Anglade, Jr.
3,553,932 A 1/1971 Rowekamp
3,555,770 A 1/1971 Rowekamp
3,555,773 A 1/1971 Rowekamp
3,648,427 A 3/1972 Raudat et al.
3,656,517 A * 4/1972 Taylor et al. ..... 141/237
3,727,366 A 4/1973 Schlueter et al.
3,771,284 A * 11/1973 Boeckmann et al. ..... 53/282
3,805,476 A 4/1974 Kawamura et al.
3,825,980 A 7/1974 Moore
3,864,890 A 2/1975 Uliman
3,938,847 A 2/1976 Peyton
3,944,058 A 3/1976 Strauss
3,958,685 A 5/1976 McDonald et al.
3,971,190 A 7/1976 McGill
4,055,943 A 11/1977 Reichert
4,159,608 A * 7/1979 Masuda et al. ..... 53/282
4,169,621 A 10/1979 McGill
4,215,521 A 8/1980 Hartness
4,294,057 A 10/1981 Winiasz et al.
4,300,330 A 11/1981 Hartness
4,320,914 A 3/1982 Simon
4,446,672 A 5/1984 Raudat
4,457,121 A * 7/1984 Johnson et al. ..... 53/247
4,483,436 A 11/1984 Krishnakumar et al.
4,528,796 A * 7/1985 Lemaire ..... 53/299
4,541,524 A 9/1985 McGill et al.
4,553,442 A 11/1985 Mazzorana
4,585,369 A 4/1986 Manesse et al.
4,587,792 A 5/1986 Hartness et al.
4,723,649 A 2/1988 Hartness et al.
4,888,936 A * 12/1989 Takahama et al. ..... 53/282
5,174,430 A 12/1992 Ebira
5,212,930 A 5/1993 Raudat
5,257,888 A 11/1993 Kronseder
5,313,764 A 5/1994 Kronseder
5,487,257 A 1/1996 Domeier et al.
5,555,709 A 9/1996 Savigny et al.
5,588,282 A 12/1996 Hartness
5,701,719 A 12/1997 Neukam
5,727,365 A 3/1998 Lashyro et al.
5,797,249 A 8/1998 Hartness
5,862,649 A 1/1999 Benz
5,975,159 A * 11/1999 Persenaire et al. ..... 141/145
6,003,286 A 12/1999 Goodman
6,209,293 B1 4/2001 Powers
6,269,615 B1 8/2001 Amborn et al.
6,286,290 B1 9/2001 Fluck
6,393,800 B1 5/2002 Schwenke
6,571,532 B1 6/2003 Wiernicki et al.
6,612,095 B2 9/2003 Hartness

OTHER PUBLICATIONS

Hartness, et al. U.S. Patent App. No. US 2003/0037514; Circular Motion Filling Machine For.Processing Parallel Rows Of. Containers And Method, Feb. 27, 2003.

Hartness, et al. U.S. Patent App. No. US 2003/0106288; Continuous Circular Motion Case Packing And Closure Apparatus And Method, Jun. 12, 2003.

Internet Screen Print, Krones Filling Closing, et al dated Jul. 5, 2002.

Pnuematic Scale Co Brochure, Easi–Flow Wine Filler, et al.

Internet Screen Print, Us Bottlers Fillers dated Jul. 5, 2002.

Internet Screen Print, US Bottlers Fillers dated Jul. 5, 2002.

Internet Screen Print, Pneumatic Scale Co Capping Equipment, Filler Equipment and Seamers dated Jul. 5, 2002.

FOGG. Filler Company, The Fill Newsletter, vol. 1, Issue 2, dated Oct. 5, 2001.

Internet Screen Print, SIG Beverages–SIG Simonazzi dated Jul. 5, 2002.

Internet Screen Print, KHS, Inc., Innofill, et al., dated Jul. 2002.

Krones Brochure, Counter–Pressure Filler, Type VP Pneumatic Valve dated Jul. 1994.

* cited by examiner

CIRCULAR MOTION FILLING MACHINE FOR PROCESSING PARALLEL ROWS OF CONTAINERS AND METHOD

This is a continuation-in-part of application Ser. No. 09/418,619 entitled Continuous Circular Motion Case Packing And Depacking Apparatus And Method, filed Oct. 15, 1999, now U.S. Patent No. 6,729,103.

BACKGROUND OF THE INVENTION

The invention relates to an apparatus and method for filling containers with a liquid, and more particularly to increasing the speed and control of containers being filled by processing containers arranged in a plurality of parallel rows rather than a single row.

Heretofore, filling machines have been provided which fill containers, such as bottles, arranged in a single file row. To achieve high production of a single row of empty containers, the filling machine must process the containers at a very high speed. A typical filling machine conveys these bottles in single file and uses a worm feed to separate these bottles because the stationary filling valves are spaced more than the single file bottles. The worm feed increases the space between the bottles and feeds them to a large infeed star wheel. The star wheel, usually 4 feet in diameter, receives the bottles in individual pockets and conveys them underneath the filling valves of a radial filler machine. The radial filler machine is typically 12 to 15 feet in diameter, and includes a filler tube having a plug that inserts into a snap-on fitting that holds the bottle. Typically, the bottle is lifted up to the filler valve when the bottle is being filled. The bottle is then lowered down onto a discharge star wheel. The discharge star wheel usually is 4 feet in diameter, so the entire machine may range from about 16 to 24 feet in overall operating diameter, depending on its configuration and floor plan. Considerable floor space is required for the typical filling machine. Particularly, when considering the bottles or other containers, also have to be capped after the filling operation so that capping stations are also required in the processing space. The basic configuration of a rotary filling machine with feed and discharge wheels is illustrated schematically in FIG. 1 of U.S. Pat. No. 6,026,867. U.S. Pat. Nos. 5,865,225 and 4,053,003 show various prior rotary filling machines, the latter having feed and discharge wheels which transfer containers by two, in radial alignment.

The typical radial filler machine processes of line of empty containers. Usually the upper speed limit of the machine is about 1200 containers per minute, or for a typical beverage bottle, about 300 feet per minute. However, at this upper limit of speed, control of the containers and filling process is sometimes unpredictable and hazardous.

Accordingly, an object of the invention is to provide a continuous motion filling machine and method having increased production yet may operate at reduced speeds under better control.

Another object is to provide an apparatus and method for processing articles in parallel rows having a simple construction with fewer parts providing high reliability.

Another object of the present invention is providing continuous circular motion filling machine and method for processing containers arranged in a plurality of parallel rows rather than a single file row, for increasing production.

Another object of the present invention is to provide a circular motion filling apparatus and method for processing containers in parallel rows wherein the apparatus may be arranged in different machine and floor configurations, depending on the application being made, with less floor space.

Still another object of the present invention is to provide an apparatus and method for filling containers in parallel and serial order where the containers are not lifted during the filling operation and may be processed on a single continuous conveyor.

SUMMARY OF THE INVENTION

The above objectives are accomplished according to the present invention by providing a continuous circular motion apparatus for filling a group of empty containers conveyed in parallel rows comprising a rotating turret which continuously rotates about a single vertical turret axis, and a plurality of articulating and reciprocating filling heads circularly arranged. The filling heads rotate along a radial path for continuously and successively filling the groups of the containers while being conveyed during a fill operation. A group of filling valves is carried by the filling heads corresponding to the arrangement of the group of containers for aligning with the containers as the filling heads are lowered into engagement with the containers. A filling-head motion converter is operatively connected to the filling heads causing the filling heads to move generally in a straight line motion along a chordal path while the filling heads rotate about the single turret axis and are lowered to engage the containers. A conveyor includes an arcuate section having an arc with a curvature generally corresponding to the radial path, and the filling operation occurs at least in part along the arcuate section.

Advantageously, there is an engagement station where the filling heads are lowered to engage empty containers on the conveyor; a release station where the filling heads are raised to disengage from filled containers on the conveyor; and the filling heads have a fill position between the engagement and release stations whereby the containers are filled during a fill operation. A reservoir is carried atop the rotating turret, rotating with the turret, for containing a liquid to be dispensed into the containers. The filling heads include accumulator tanks in fluid communication with the reservoir for receiving liquid to be dispensed into the containers. The group of filling valves carried by the filling head are in fluid communication with the accumulator tank and have an open position for dispensing fluid into the containers and a closed position for blocking the dispensing of liquid after the containers are filled. A vertical motion mechanism is operatively associated with the filling heads for controlling operative vertical positions of the filling heads to engage the containers on the conveyor at an engagement station, and to disengage the containers on the conveyor at a release station as said turret and the filling heads continuously rotate about the single turret axis.

The conveyor includes an infeed section and an outfeed section wherein the arcuate section is disposed between the infeed and outfeed sections. The infeed conveyor section includes a generally straight conveyor run for feeding empty containers to the filling heads for engagement. A plurality of capping stations is disposed downstream for placing a cap on filled containers created by filling the empty containers and the outfeed conveyor section includes a generally straight conveyor run for conveying filled containers to the capping stations. The outfeed conveyor section includes a lane assembly for arranging the group of articles in parallel rows for delivery to selective ones of the capping stations for capping the filled containers.

According to the invention, a method of filling containers with a liquid during a filling operation includes providing a plurality of circularly-arranged, reciprocating filling heads and continuously rotating the filling heads about a single vertical axis which feeding containers arranged in parallel rows to an engagement station along a conveyor. The filling heads are lowered to sequentially engage the containers along the engagement station, and the filling heads are controlled to move along a straight line path while rotating about the single axis as the filling heads engage the containers. The method includes filling the containers as the containers are conveyed along an arcuate path about the single axis while the filling heads are rotating about the single axis; and raising the filling heads to disengage from said containers after the containers are filled. An infeed conveyor section and the outfeed conveyor sections are arranged parallel to one another, and the method includes arranging a plurality of capping stations along the outfeed conveyor sections for receiving and capping the filled container.

DESCRIPTION OF THE DRAWINGS

A construction designed to carry out the invention will now be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENTS

Figure 1:
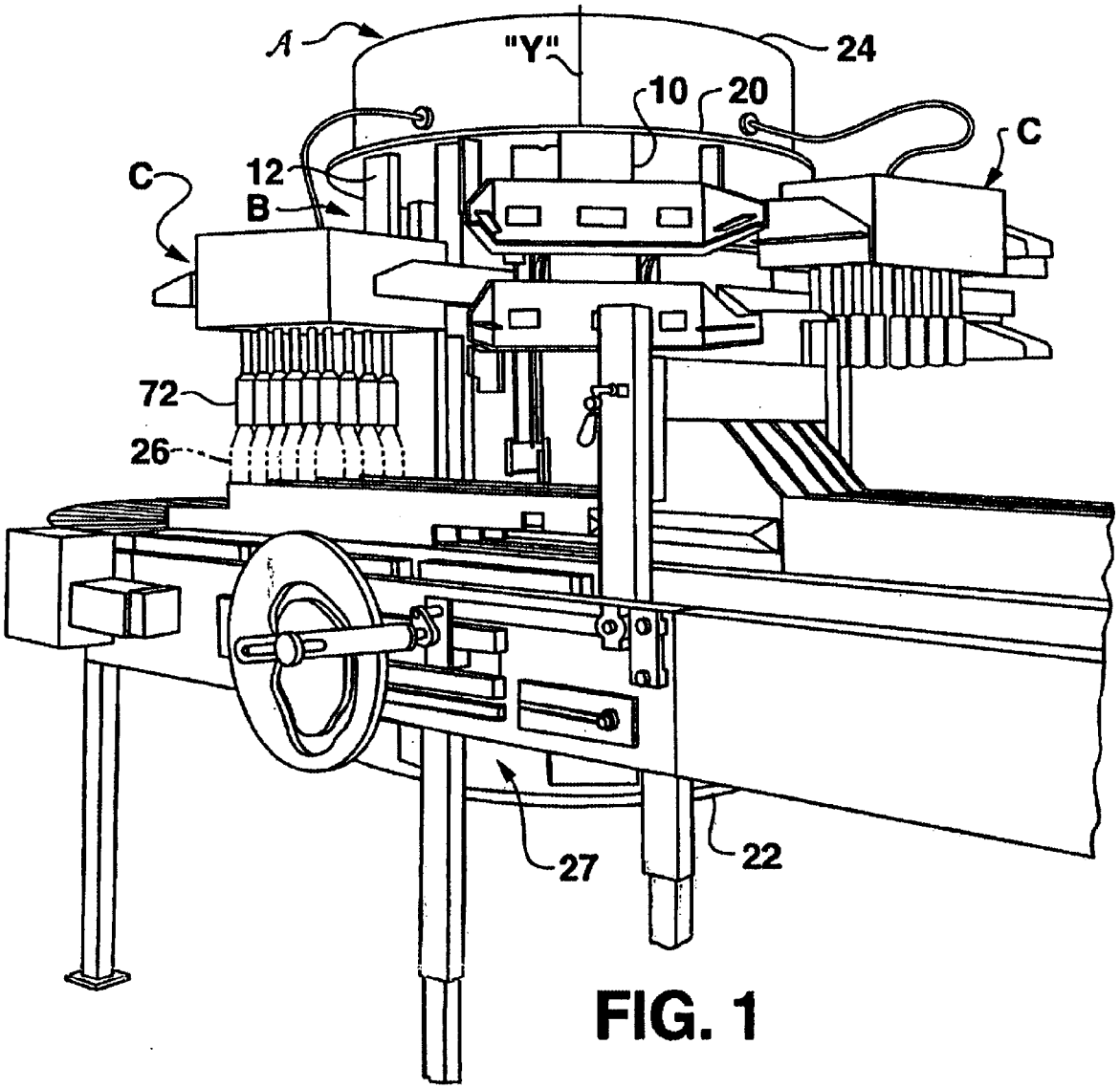
FIG. 1 is a perspective view of a continuous circular motion apparatus and method for filling containers arranged in groups of parallel rows constructed according to the invention.

Referring now to the drawings, the invention will now be described in more detail.

Figure 2:
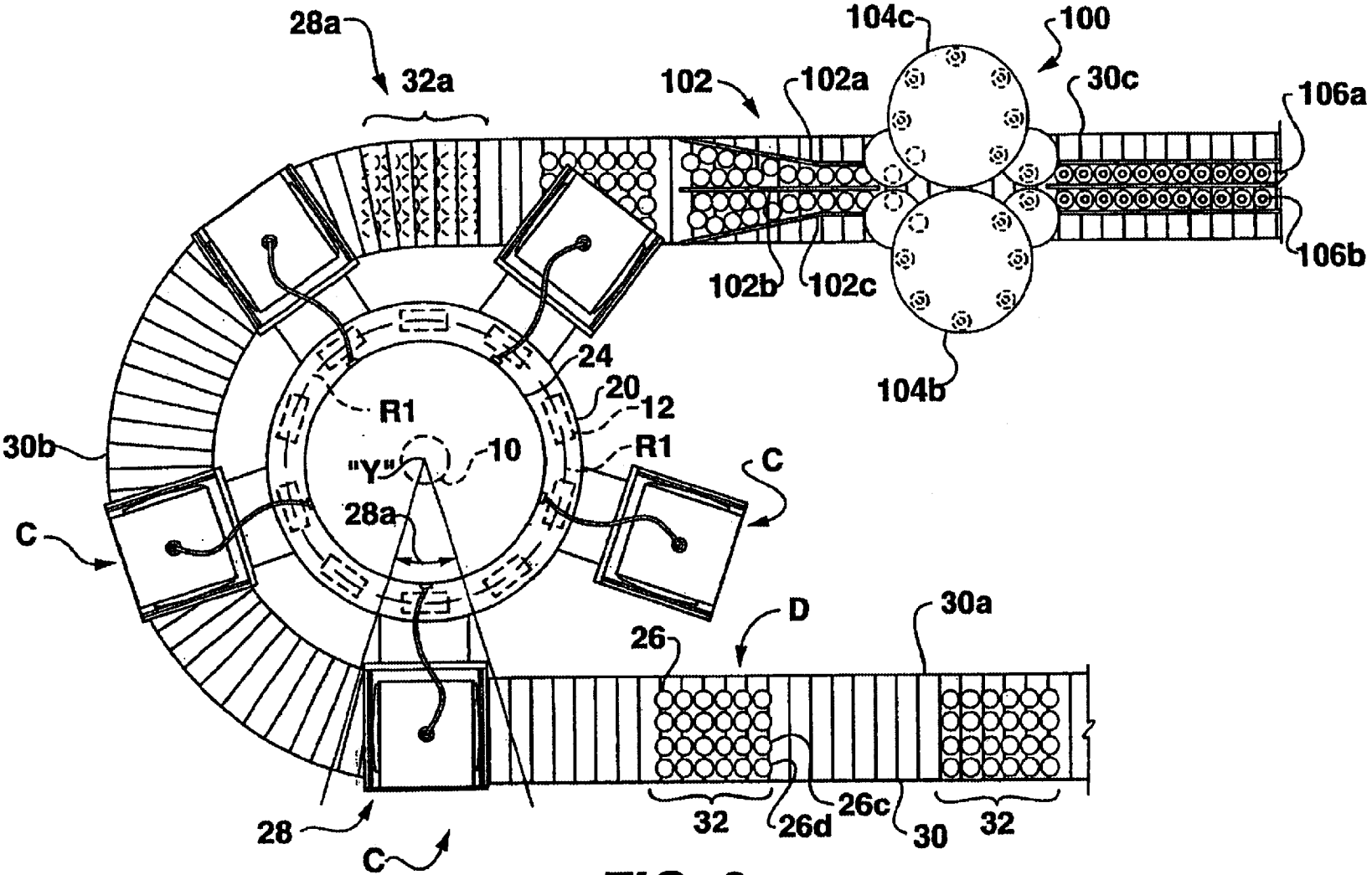
FIG. 2 is a top plan view of the circular motion apparatus and method of FIG. 1 wherein empty containers are conveyed on a conveyor to an engagement station for engagement with filling heads, a fill operation takes place over an arcuate section of the conveyor, and the filled containers are conveyed by the conveyor to a capping station.
Figure 4:
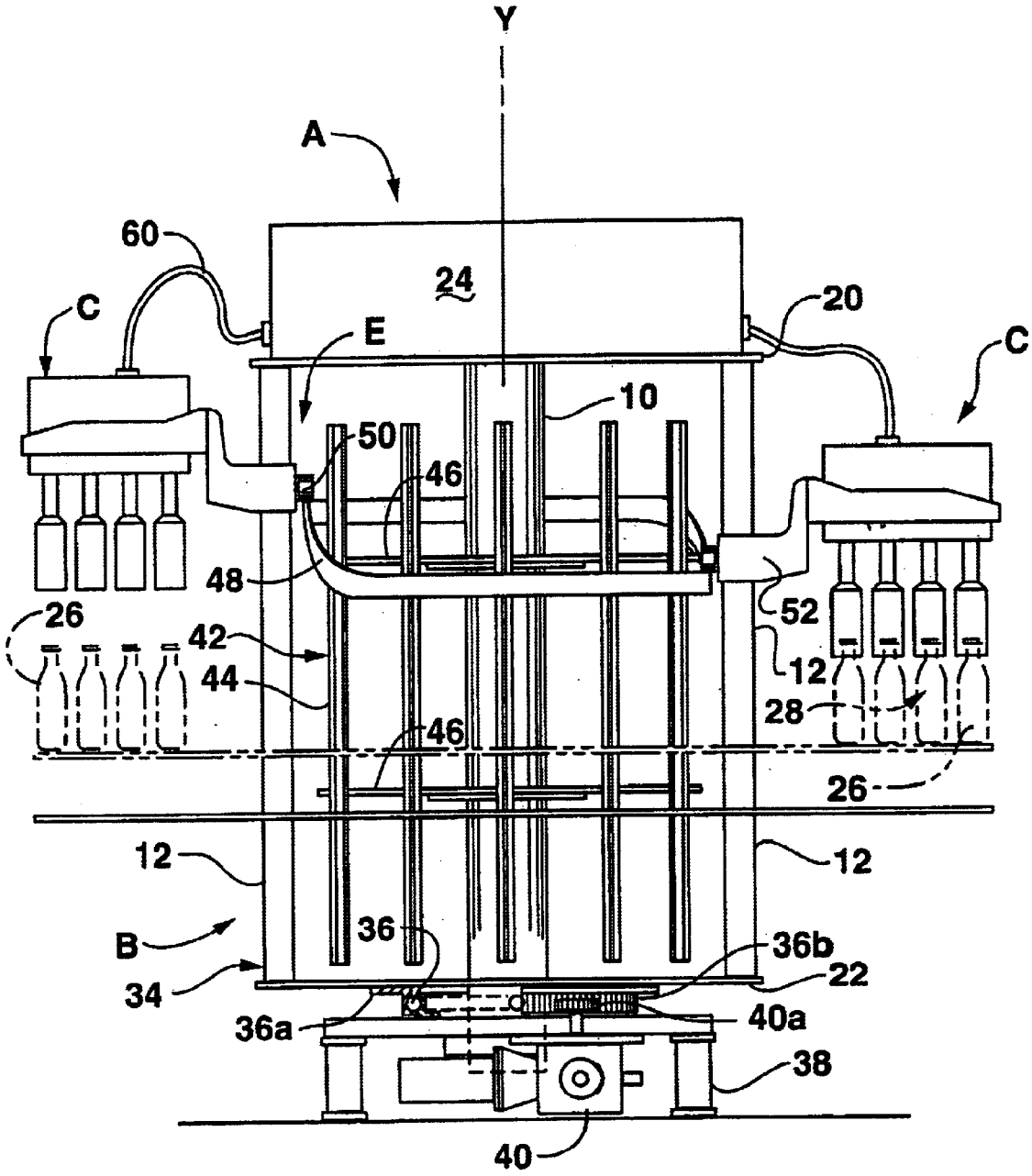
FIG. 4 is a simplified side elevation illustrating a continuous circular motion apparatus and method for filling empty containers wherein a turret is illustrated which rotates about a single vertical axis with filling heads circularly arranged about the turret rotating about the single vertical axis.
Figure 5:
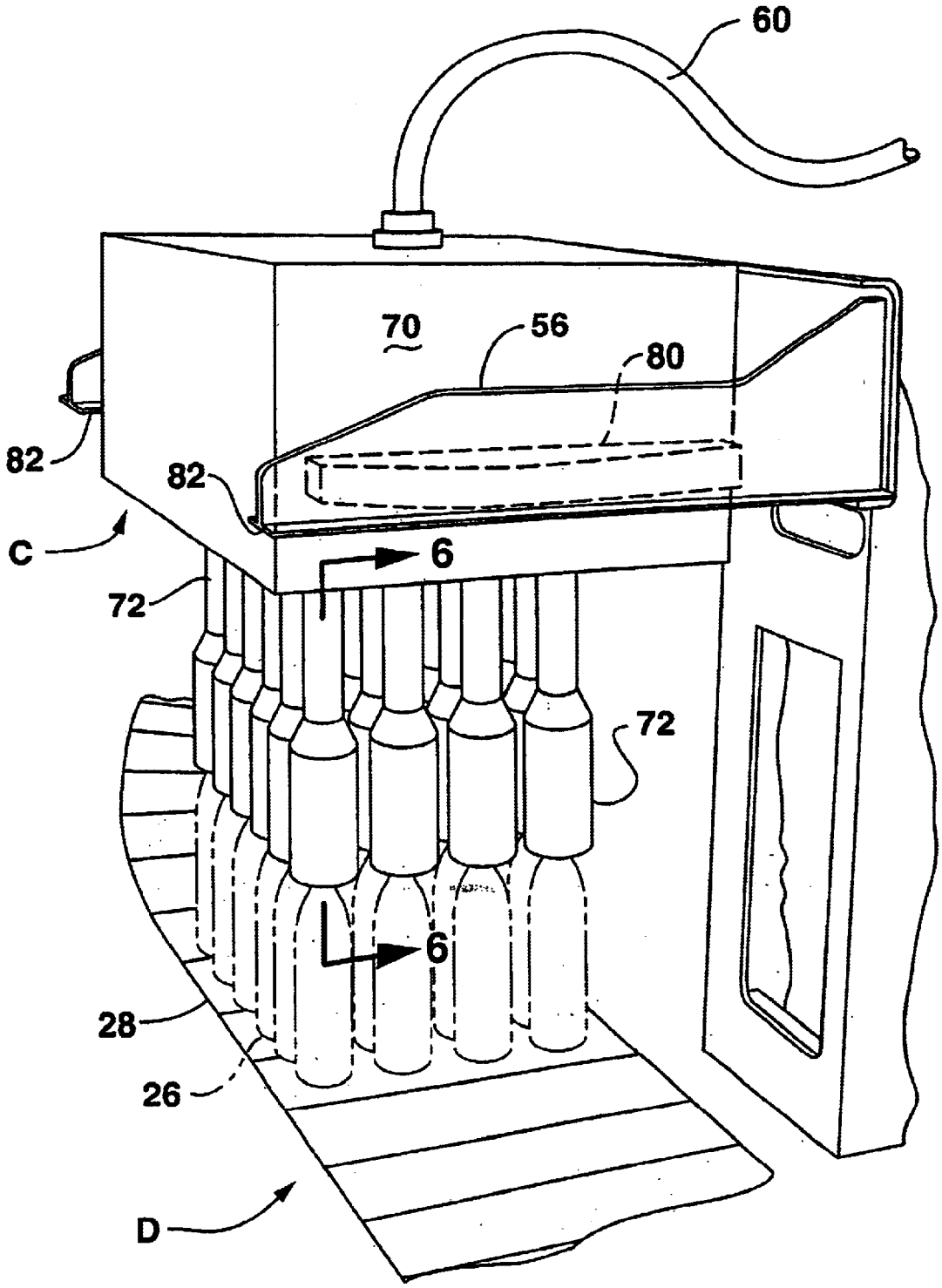
FIG. 5 is a perspective view illustrating empty containers arranged in a group of side-by-side rows being engaged by filler tubes carried by the filling heads arranged corresponding to the group of empty containers.

As can best be seen in FIG. 1, apparatus and method for filling containers, designated generally as A, is illustrated which is of simple construction and based on a continuous circular motion. The apparatus includes a rotating turret B illustrated in the form of a cage rotating about a single vertical turret axis Y, and a stationary central column 10. Turret B includes a plurality of circularly arranged support arms 12 which are connected to and generally form a cage rotating about central column 10, as can best be seen in FIG. 4. Support arms 12 are carried between upper and lower circular plates 20, 22 (FIGS. 2 and 4). A plurality of reciprocating processing or filling heads, designated generally as C, are slidably carried on support arms 12 for carrying out a process on articles or containers. In the illustrated embodiment, a particularly advantageous embodiment is disclosed for filling empty beverage containers and the like. When used in the filling process illustrated herein, a reservoir 24 is carried by upper rotating plate 20 and contains a liquid used to fill empty containers 26.

Figure 3:
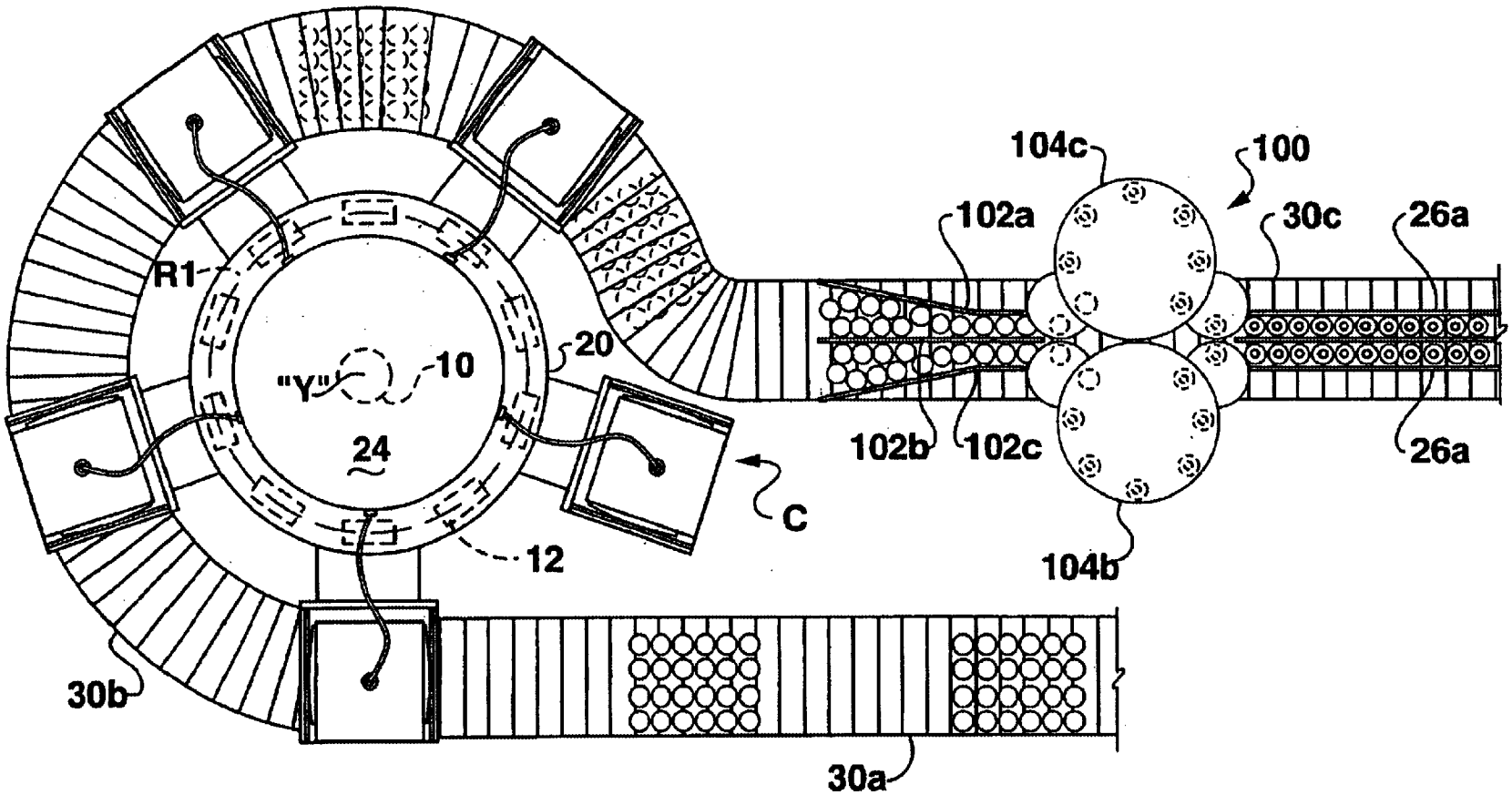
FIG. 3 is a top plan view of a continuous circular motion filling apparatus and method of claim 1 having a conveyor which conveys empty containers to an engagement station wherein the fill operation takes places over a greater arc of the conveyor than the fill operation of FIG. 1 whereupon the filled containers are conveyed to a capping station.

As can best be seen in FIG. 2, an article feeder, designated generally, as D, is illustrated for conveying empty containers to an engagement station 28 where the empty containers are operationally engaged by the filling heads over an arc 28*a*. Article feeder D includes an infeed conveyor section 30 having a straight run on which containers 26 are conveyed in a group 32 of parallel, linear single-file rows 26*a*, 26*b*, 26*c* and 26*d* to engagement station 28. For this purpose, a slug feeder, designated generally as 27 (FIG. 1), may be utilized to arrange scrambled containers into groups 32 of containers arranged in rows 26*a*–26*d*. A suitable slug feeder is disclosed in applicant's copending application Ser. No. 09/418,619 entitled *Continuous Circular Motion Case Packing and Depacking Apparatus And Method*, filed Oct. 15, 1999, which application disclosure is incorporated into the present application by reference. The slug feeder includes a metering section receiving a continuous flow of containers wherein the metering section separates the containers into a plurality of group 32 containers and delivers groups of containers to engagement station 28. Conveyor 30 includes an infeed section 30*a*, an arcuate section 30*b*, and an outfeed section 30*c* (FIG. 2). Alternately, conveyor 30 may include an arcuate section 30*b* that extends approximately 270 degrees, as shown in FIG. 3. The embodiment of FIG. 3 provides a longer arcuate path over which the fill operation may be conducted. Other conveyors and machine configurations may also be had according to the application being made.

Referring now in more detail to turret B, as can best be seen in FIGS. 1, 2, and 4, turret B includes top plate 20 and bottom plate 22 between which transfer arms 12 are circularly arranged and fixed. Transfer arms 12 are illustrated in the form of steel beams and define the outer limits of a turret cage 34. Transfer arms 12 rotate in a first radial path R1 while the filling heads C rotate in a second radial path R2

Figure 9:
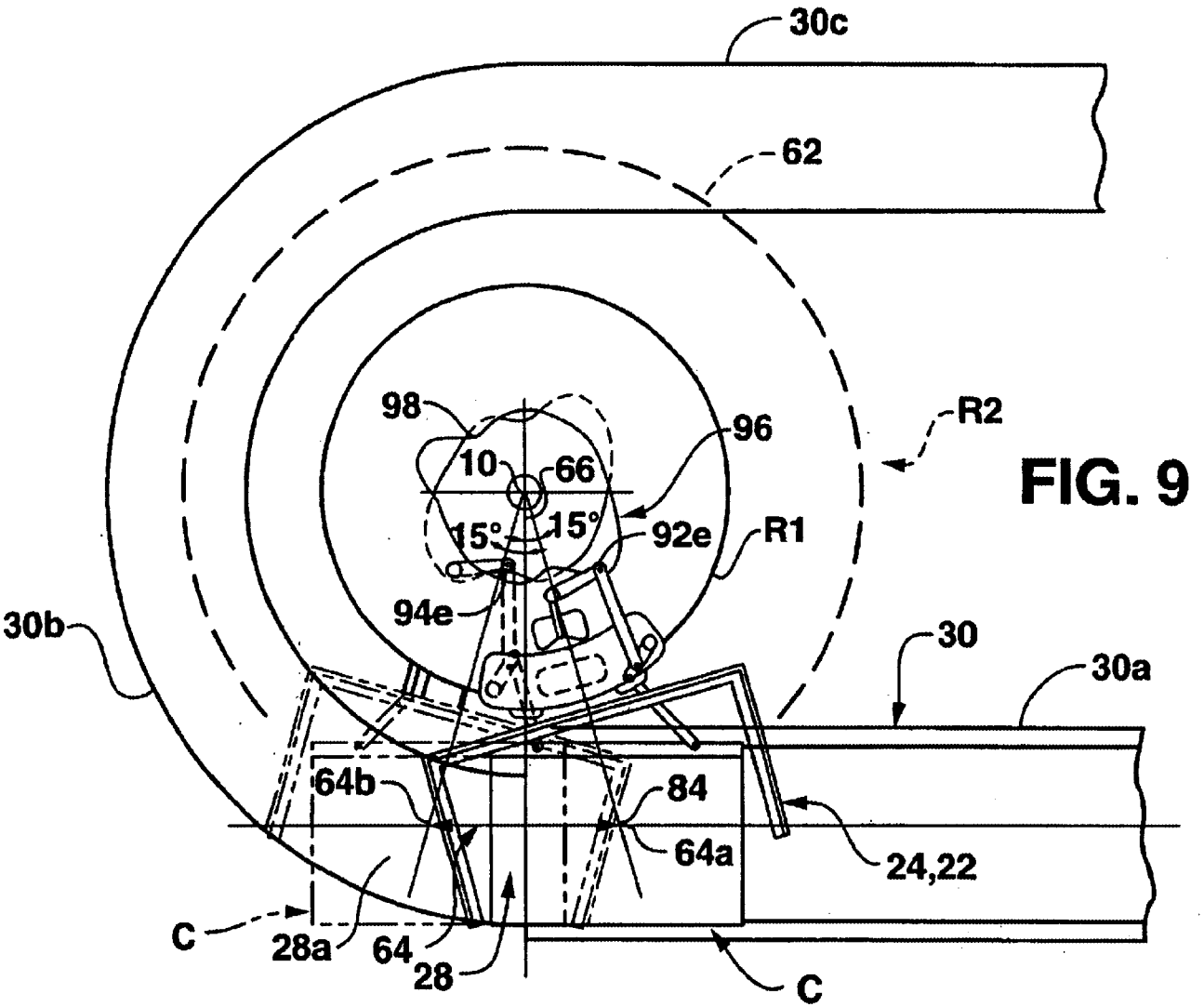
FIG. 9 is a top plan view illustrating a first radial path of a turret and a second radial path of the filling heads according to the continuous circular motion filling apparatus and method of the invention wherein the filling heads are controlled to move along a chordal path of the second radial path as the filling tubes engage the containers in a group.
Figure 10:
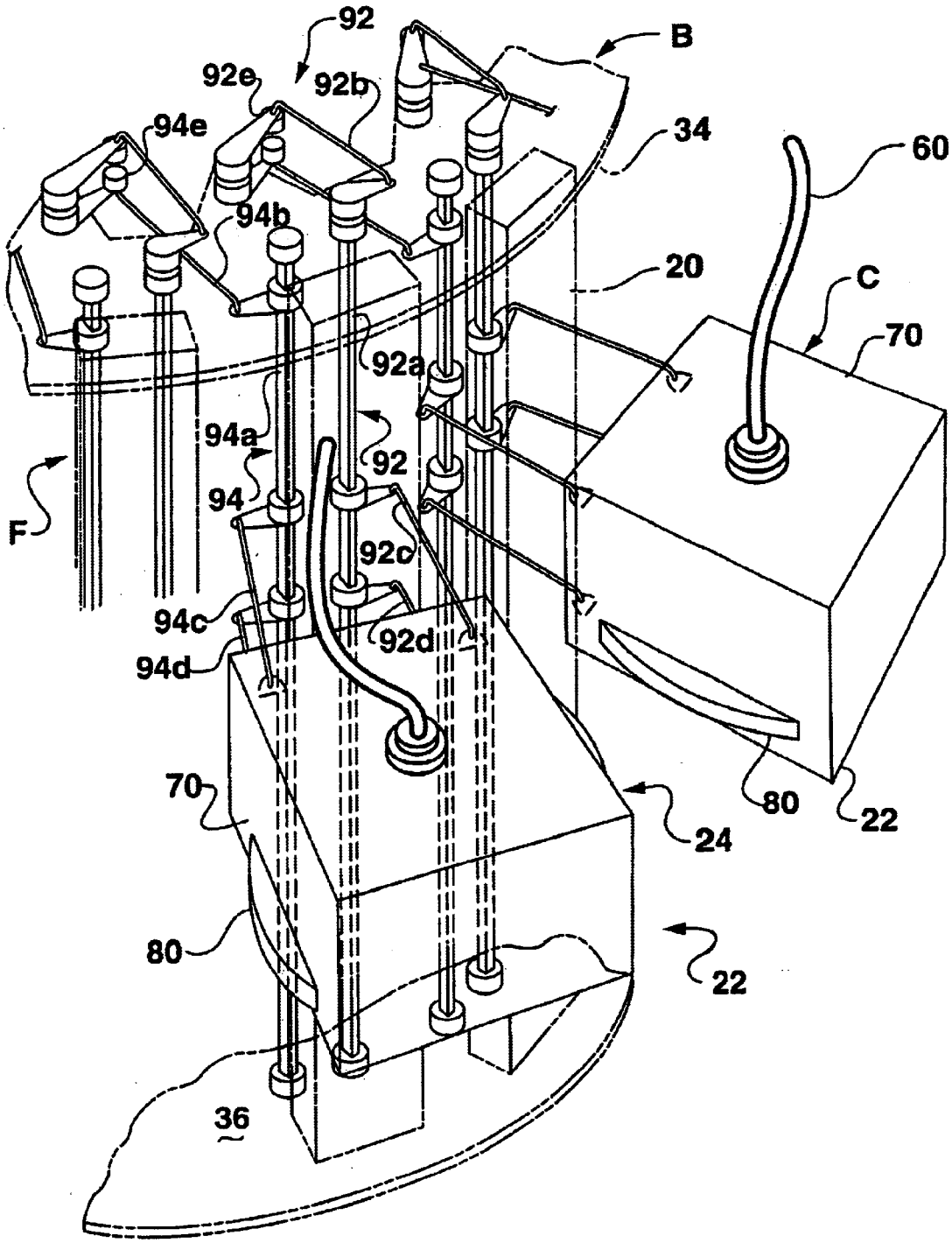
FIG. 10 is a perspective view with parts omitted illustrating an articulation assembly for converting the circular motion of the filling heads about a radial path into a straight line motion over a predetermined distance so that the filler tubes reliably engage the empty containers.

(FIG. 9). In the illustrated embodiment, there are 10 support arms spaced around the turret cage and 5 filling heads carried by the support arms. The number of support arms and/or filing heads, of course, may vary depending upon the application. A drive for the rotating turret is provided by a ring bearing 36 having an outside ring gear 36*a* affixed to bottom plate 22, and an inner bearing gear 36*b* affixed to a frame 38 supported on the floor (FIG. 4). Gear 36*b* is meshed in driving arranged with ring gear 36*a* and a drive gear 40*a* of a gear motor 40, also mounted to frame 38. Within the interior of turret B, as defined by turret cage 34, is stationary central support or column 10 supported by frame 38. Affixed to central support column 10 is a cam support drum 42 having a plurality of vertical braces 44 affixed to the central support column by intermediate connector plates 46. Central support 10 extends through clearance holes (not shown) formed in upper and lower plates 20, 22. In this manner, turret B, as mainly including plates 20, 22, cam support drum 42, circumferential cam 48, and support arms is 12, rotates about stationary support 10. Circumferential cam 48 surrounds a cam support drum 42 and is affixed to the drum. Cam 48 controls the vertical position of filling heads C as turret B rotates. Cam 48 forms part of a vertical motion mechanism, designated generally as E, described below. The vertical drum braces, circular plates, cams and central support may be affixed together in any suitable manner, such as welding, bolts, and the like to define an integral structure which is stationary.

Figure 8:
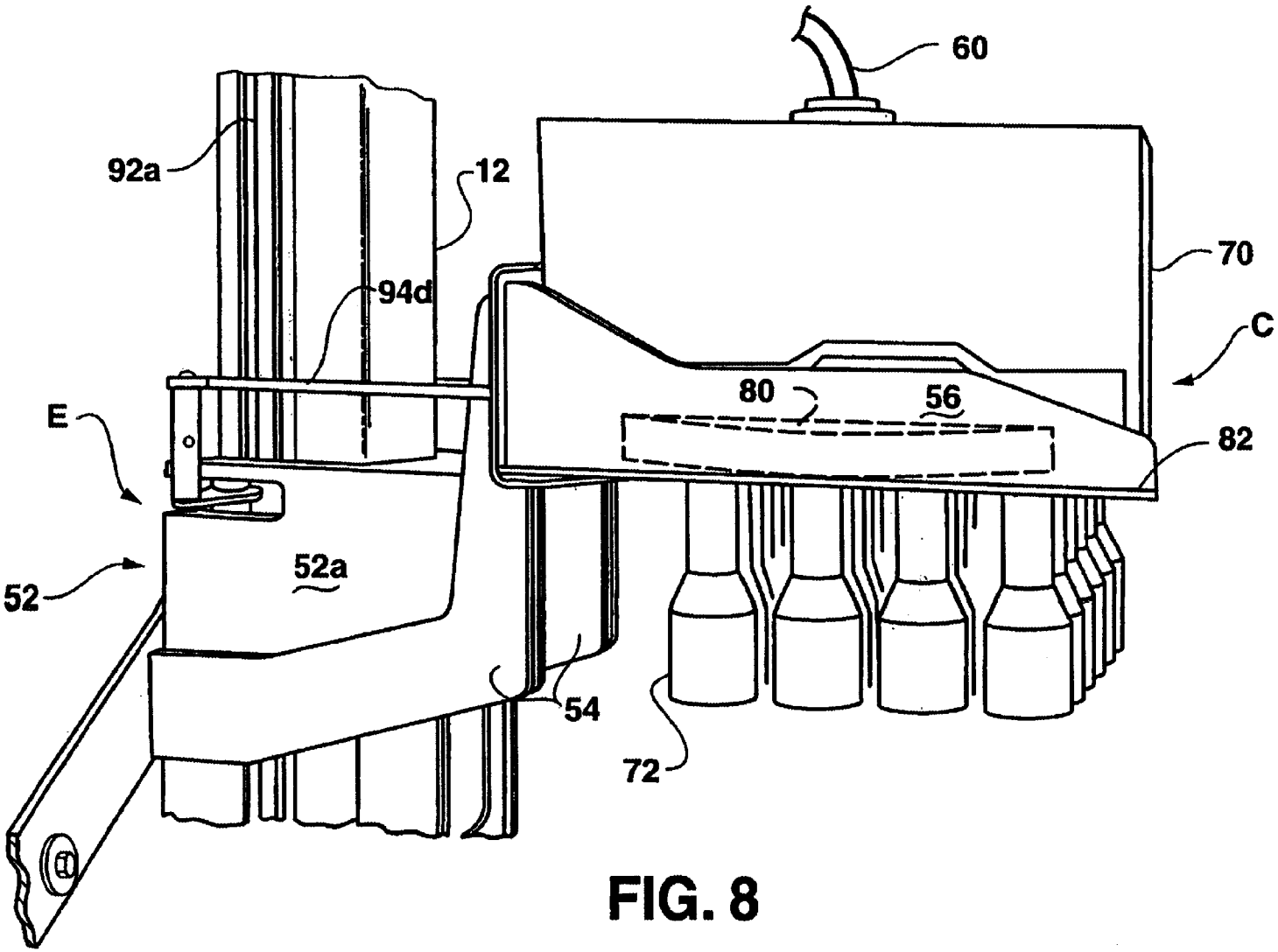
FIG. 8 is a perspective view illustrating parts of a vertical motion mechanism for controlling the vertical position of the filling heads as they with turret during the filling operation according to the invention.

Vertical motion mechanism E controls the vertical position of filling heads C, as can best be seen in FIGS. 4 and 8, and includes cam 48 and cam rollers 50 carried by filling heads C. Cam rollers 50 ride on cam 48 and are rotatably carried by guide bearing assemblies, designated generally as 52, which slide on support arms 12. Each guide bearing assembly includes a bearing block 52*a* which slides on arm 12, a pair of support arms 54. A support tray 56 is carried by support arms 54, and filling head C is carried by support tray 56. As cam roller 50 rides up and down on cam 48, support tray 56 raises and lowers accordingly. In this manner, the vertical position of filling heads C is controlled while rotating with turret B by the track of circumferential cam 48 stationarily affixed to cam drum 42 affixed to stationary central column 10. It will be noted that liquid reservoir 24 also rotates with turret B and filling heads C so that a flexible fluid connection 60 between reservoir 24 and respective filling head C can be had. The reservoir may be provided with a fluid rotary coupling (not shown) by which the reservoir is replenished from an outside source.

As can best be seen in FIG. 9, filling heads C move in second radial path R2 as they are rotated by turret B while support arms 12, on which they are carried, rotate in first radial path R1. In accordance with a particular advantageous aspect of the invention, the circular path of filling heads C is altered over a prescribed distance at engagement station 28, corresponding to arc 28*a*, so that filling heads C move in a straight line path 64, from a point 64*a* to a point 64*b*, and remain aligned with containers 26 during lowering and engagement. In the illustrated embodiment, the straight-line path corresponds to a chordal path of a circle defined by radial path R2. In this manner, reliable alignment of the filling heads with a group of articles beneath the filling heads is had at engagement station 28 for operational engagement. For this purpose, a filling-head motion converter assembly, designated generally as F, is provided for causing filling heads C to convert from a circular path to straight line path 64 over a prescribed arc 28*a* of rotation of turret B, depending on the application being made. In the illustrated embodiment the motion converter assembly is provided by an articulated structure that allows relative motion between the turret arms 20 and the filling heads C, as will be more fully described below.

Figure 6:
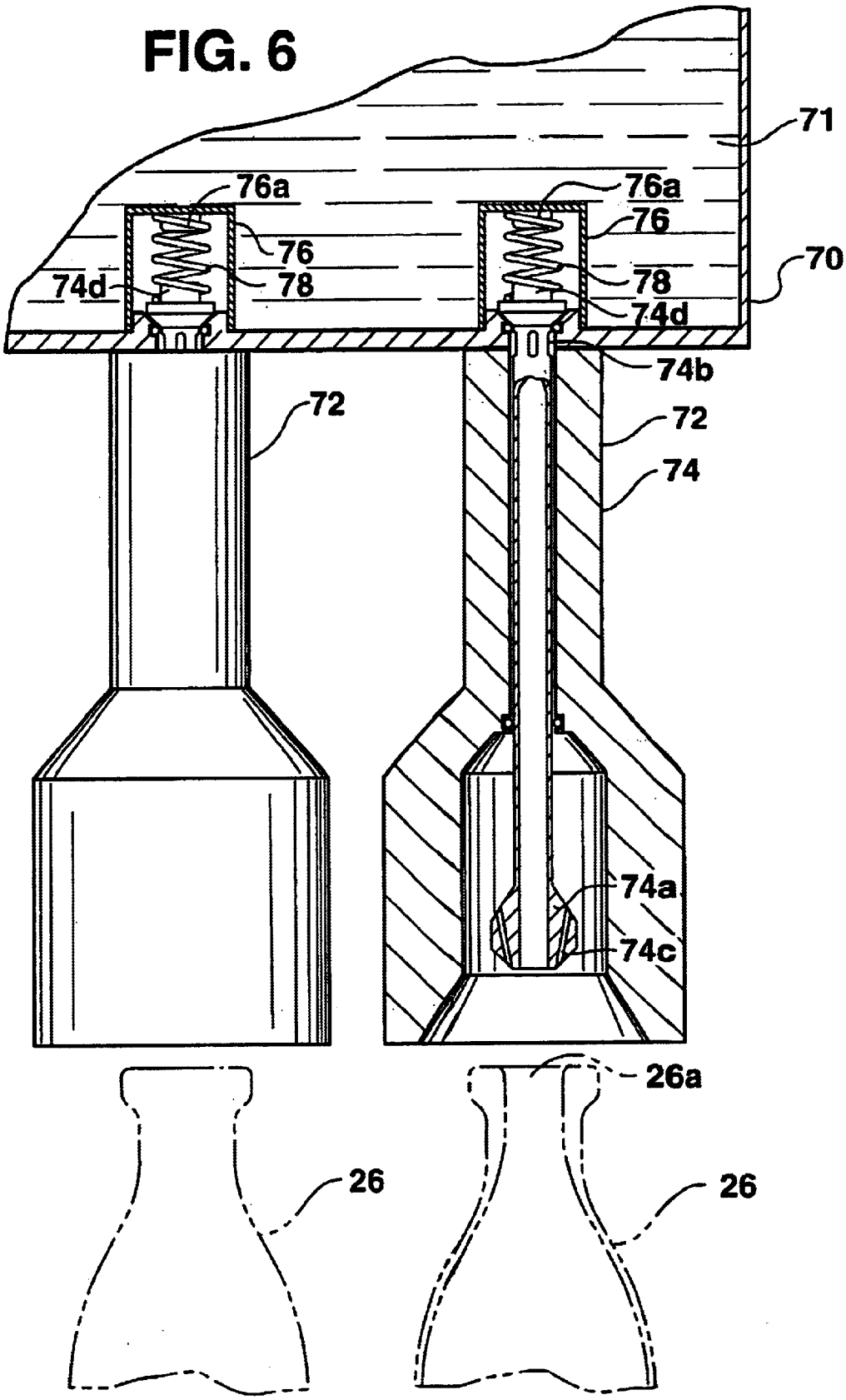
FIG. 6 is a side elevation illustrating a filler tube in section prior to the filling head being lowered into engagement with the container.
Figure 7:
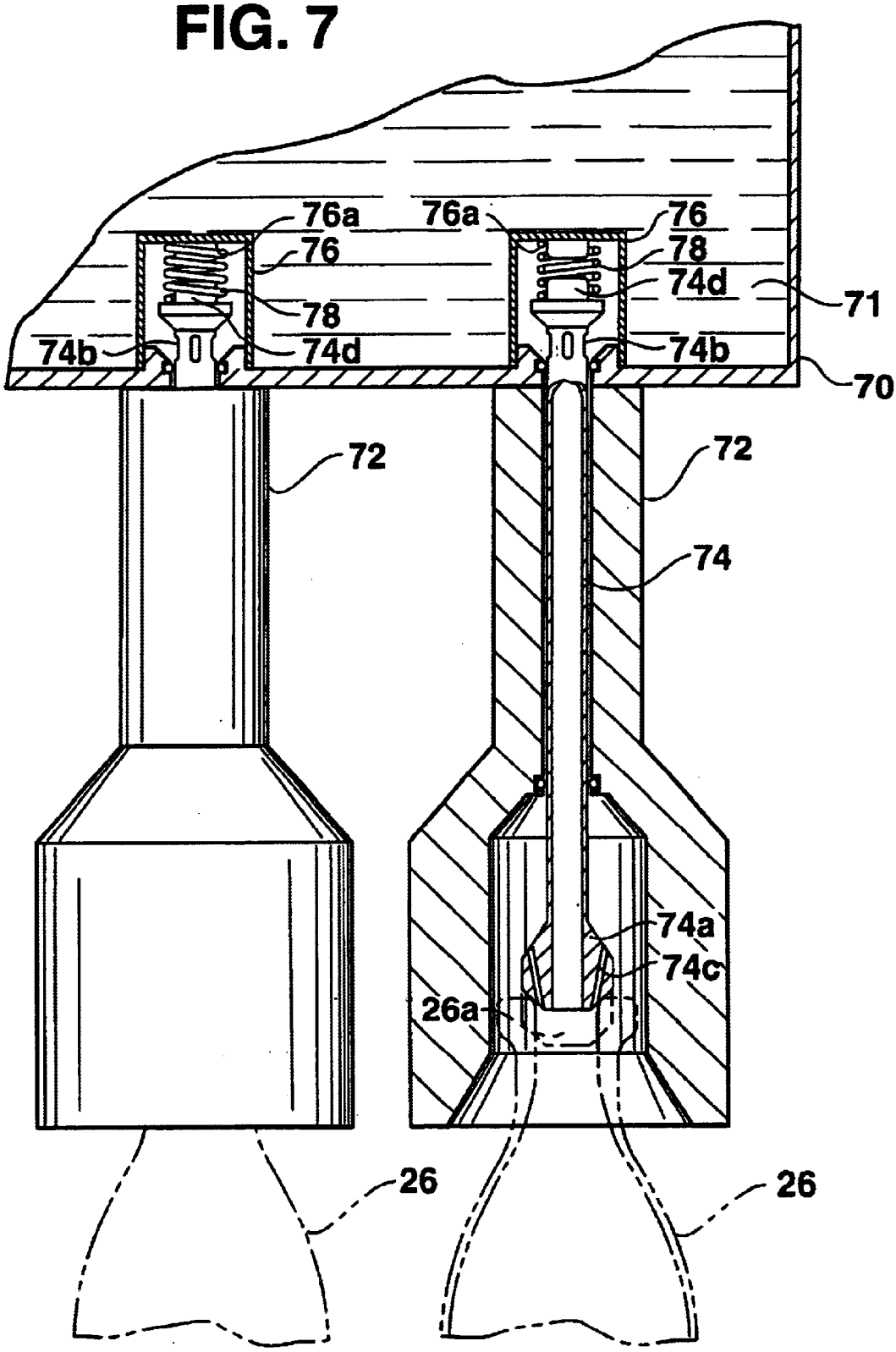
FIG. 7 is a side elevation with a filler tube in section illustrating a valve of a filler tube engaging an empty container for filling.

Filling heads C will now be described in more detail. As can best be seen in FIGS. 4 through 8, each filling head includes an accumulator 70 in the form of a rectangular container which receives liquid from main reservoir 24 to be dispensed in empty containers 26. Filling heads C include a plurality of filler tubes 72 which are arranged in an array corresponding to the array of 15 containers in group 32. Each filler tube includes a reciprocating filling element or valve 74 which is spring biased to a closed position (FIG. 6). Filling valve 74 includes an outlet end 74*a* and an inlet end having a plurality of end openings 74*b*. When filling head C is lowered, outlet end 74*a* of the filling valve engages container opening 26*a* of container 26. Further lowering of filling head C moves filling valve 74 to an open position in which inlet openings 74*b* are in fluid communication with liquid 71 in container 70 (FIG. 7). The liquid is then delivered into the empty container until it is full. Air vent openings 74*c* are included in valve 74 for venting and relieving air from container 26 during filling. As soon as all the air is vented from the bottle, the filling operation stops. Container 70 includes a valve bracket 76 having a button 76*a*. A spring 78 is carried on button 76*a* and a button 74*d* on valve 74 to extend therebetween and bias filler valve 74 downwardly. The illustrated filler tube and filling valve arrangement is suitable mainly for non-carbonated beverages, such as water, fruit and vegetable juices. Any suitable filling head valve and arrangement may be utilized for the beverages such as are available from several commercial sources such as U.S. Bottlers Company, Inc of Charlotte, N.C. It will be understood, of course, that other valve arrangements may also be utilized for non-carbonated and carbonated beverages such as beer and soft drinks, in accordance with the present invention.

It is noted that filling head reservoir 70 includes a curved bearing block 80 on opposing sides of the container. Bearing blocks 80 are received on parallel ledges 82 of support tray 56 so that the entire filling head C may rotate on the support tray as well as slide linearly. It is this combination of rotation and linear motion that allows the motion converter assembly to convert the circular motion of the filling heads to a straight line motion.

Referring to FIGS. 5, 8–10, filling-head motion converter F for controlling the processing heads in an articulating manner, will now be described in more detail. As noted above, each filling head C is slidably carried in support frame 56, and there is defined a swivel axis 84 for the filling head as supported by tray 56 (FIG. 9). In this manner, filling heads C rotate about single turret axis Y, as they are carried by turret B, and articulate about swivel axis 84 at the same time. The processing head are controlled in a resultant straight-line path 64 path during initial engagement with containers 26, for example, at engagement station 28. Motion converter assembly F includes a plurality of connector mechanisms, designated generally as 90, connected between rotating turret B and a respective filling head C to control movement of a filling head so it moves in straight line or chordal path 64 along engagement station 28 to align accurately with a group 32 of containers. As can best be seen in FIG. 10, a connector mechanism 90 includes a first linkage arrangement 92 connected to one side of the filling head, and a second linkage arrangement 94 connected to an opposite side of the filling head. The linkage arrangements include rotary-motion transfer camshafts 92*a* and 94*a* carried vertically between top and bottom turret plates 20 and 22. Upper arm links 92*b* and 94*b* are received about upper ends of the camshafts and are secured against rotation. In this manner, actuation of upper links 92*b* and 94*b* causes rotation of the camshafts. Lower arm links 92*c* and 94*c* are slidably carried on camshafts 92 and 94 respectively. Lower arm links 92*c* and 94*c* are affixed to opposing sides of filling head C. Cam followers 92*e* and 94*e* are carried by upper links 92*b* and 94*b*, and follow a cam plate 96 which is affixed to the top of stationary column 10 (FIG. 9). The cam followers ride in a cam groove 98 and follow cam plate 96 to actuate lower arm links 92*c* and 94*c* to swivel the filling heads an effect the resulting straight-line motion at engagement station 28. The incorporated patent application describes this in more detail. In this manner, reliable insertion of filling valves 74 into the containers is had.

The motion of the filling head can best be seen in FIG. 9, as filling head C is maintained parallel and straight as the filling head is lowered onto the group of containers. It is to be understood, of course, that other means for articulating the filling heads C to convert the movement of the filling head from a circular path to a straight line path for alignment with the group of containers may also be had rather than the illustrated mechanism. For example, use of position sensors in control to electronic gear motor may be had, or hydraulic control systems, as well as other mechanical arrangements. In addition, other forms of rotating turrets or carousels may be used to rotate the processing heads in a circle. For example, an overhead rotating turret or umbrella structure with radial arms and depending processing heads may be utilized. In this case, the radial path of the rotating turret and processing heads is the same. The processing heads are carried to articulate about a vertical axis circumscribing the same circle as the heads. The heads may be made to articulate and maintain a straight-line path at any number of operational zones along the circular path. It may also be possible to lift the containers from underneath for engagement with the processing heads rather than overhead, without departing from the advantageous aspects of the invention, although overhead is preferred.

As can best be seen in FIGS. 2 and 3, a capping station, designated generally as 100, is disposed along a straight run of outfeed conveyor station 30*c*. Capping station 100 may include a pair of conventional rotary cappers 104*b* and 104*c*. A laner assembly designated generally as 102 is provided to divide the groups of filled containers into a pair of single file rows 106*a* and 106*b*. Laner assembly 102 includes a plurality of lanes 102*a*, 102*b*, and 102*c* in a conventional manner. The rotary cappers place caps on the filled containers so that rows 106*a* and 106*b* on the exit side of the capping station include capped, filled containers. Variations and other arrangements of cappers may be had at the capping station, as well as various arrangements of capping stations in order to facilitate capping of any number of rows of single file bottles that may be produced by the filling apparatus and method of the invention.

The operation of the filling apparatus and method of the invention will now be described. After engagement of a filling head C with a group 32 of containers 26, the filling operation takes place substantially over a 180 degree arc from engagement station 28 to a release station 28*b*. At engagement station 28 the filling heads are lowered onto the groups of containers along straight line path 64. The containers, with filling valves engaged, are conveyed along an arcuate path, and the empty containers are filled with the liquid. At release station 28*b*, the filling head is raised from a group of containers so that successive groups 32*a* of filled containers exit at release station 28*b*. The groups of filled containers are then conveyed to capping station 100. At the capping station, lane dividers for separate and arranging the containers in the group in a pair of parallel, single file rows 102*a* and 102*b*. The rows are then passed through rotary cappers 104*b* and 104*c* which place caps on the filled containers 26*a*. The filled containers are then transferred for packaging. It is to be understood, of course, that other arrangements may be had at a capping station where more than two rows of single file containers are provided with additional cappers, perhaps downstream, for faster processing.

Thus, it can be seen, that an advantageous construction can be had for a filling machine to fill containers using a continuous, circular motion apparatus and method comprising rotating filling heads circularly arranged on a turret and having an articulated connection by which the heads depart from a circular path and move in a straight line to engage groups of empty containers arranged in plural, parallel rows, rather than a single row as utilized in the prior art so that increased production and overall reliability is enhanced. In accordance with apparatus and method of the present invention, containers or articles may be processed at half the linear speed for better control of the process, while the output is increased by 50% or more.

While a preferred embodiment of the invention has been described using specific terms, such description is for illustrative purposes only, and it is to be understood that changes and variations may be made without departing from the spirit or scope of the following claims.

What is claimed is:

1. A continuous circular motion apparatus for filling a group of containers arranged in parallel single file rows comprising:

a conveyor for conveying a group of empty containers arranged in parallel rows;

a rotating turret which continuously rotates about a single vertical turret axis;

a plurality of articulating filling heads carried by said turret circularly arranged about said turret, said filling heads rotating along a radial path for continuously and successively filling said groups of the containers on said conveyor during a fill operation;

a group of filling elements carried by said filling heads arranged in groups corresponding to the arrangement of said group of containers for aligning with said containers as said filling heads are lowered into engagement with said groups of containers; and a filling-head motion converter operatively connected to said filling-heads causing said filling heads to move generally in a straight line motion along a chordal path while said filling heads rotate about said single turret axis and are lowered to engage said containers.

2. The apparatus of claim 1 wherein said conveyor includes an arcuate section having an arc with a curvature generally corresponding to that of said radial path, and said filling operation occurs at least in part along said arcuate section.

3. The apparatus of claim 2 wherein said conveyor includes an infeed section and an outfeed section wherein said arcuate section is disposed between said infeed and outfeed sections.

4. The apparatus of claim 3 wherein said infeed conveyor section includes a generally straight conveyor run for feeding empty containers to said filling heads for engagement.

5. The apparatus of claim 3 including a plurality of capping stations for placing a cap on filled containers created by filling said empty containers and said outfeed conveyor section includes a generally straight conveyor run for conveying filled containers to said capping stations.

6. The apparatus of claim 5 wherein said outfeed conveyor section includes a lane assembly for arranging said group of articles in parallel rows for delivery to selective ones of a plurality of capping stations for capping said filled containers.

7. The apparatus of claim 3 wherein said infeed conveyor section, arcuate conveyor section, and outfeed conveyor section comprise a single continuous conveyor.

8. The apparatus of claim 2 wherein said arcuate section ranges from about 90 to 270 degrees about said single turret axis.

9. The apparatus of claim 1 including a reservoir carried atop said rotating turret, rotating with said turret, for containing a liquid to be dispensed into said containers; and said filling heads including accumulator tanks in fluid communication with said reservoir for receiving liquid to be dispensed into said containers.

10. The apparatus of claim 9 wherein said group of filling elements carried by said filling head are in fluid communication with said accumulator tank and include valve elements having an open position for dispensing fluid into the containers and a closed position for blocking the dispensing of liquid after the containers are filled.

11. The apparatus of claim 10 wherein said turret includes support arms circularly arranged about said turret; and said motion converter includes:

support frames carried by said support arms for slidably carrying said filling heads so that said filling heads may swivel about a swivel axis relative to said support frame as said frames and filling-heads rotate about said single turret axis; and connector mechanisms interconnected between said rotating turret and said filling heads for imparting swivel motion to said filling heads on said frames.

12. The apparatus of claim 1 wherein said filling heads are carried for reciprocation by said turret, and including a vertical motion mechanism operatively associated with said filling heads for controlling operative vertical positions of said filling heads to engage said containers on said conveyor at an engagement station, and to disengage said containers on said conveyor at a release station as said turret and said filling heads continuously rotate about said first and second radial paths and said single axis.

13. The apparatus of claim 12 including an upstanding stationary support disposed inwardly of said rotating turret about which said turret and filling heads rotate; and said vertical motion mechanism including at least one circumferential cam carried by said stationary support, and cam rollers associated with said filling heads which ride on said circumferential cam as said turret rotates to control the vertical positions of said filling heads.

14. The apparatus of claim 13 including support arms circularly arranged around said turret, said filling heads being slidably carried by said support arms in a vertical direction.

15. The apparatus of claim 1 wherein said filling-head motion converter moves said filling heads in a straight line distance which corresponds to a prescribed arc of rotation of said turret.

16. The apparatus of claim 1 wherein said turret includes support arms circularly arranged about said turret; and said filling head motion converter includes support frames slidably carried by said support arms for carrying said filling heads so that said filling heads may swivel about a swivel axis relative to said support frame as said frames and filling heads rotate about said turret axis, whereby said filling heads move in said straight line motion.

17. The apparatus of claim 16 including connector mechanisms interconnecting said turret and filling heads causing said filling heads to swivel;

wherein said connector mechanisms include vertical cam shafts, linkage arrangements connected between said transfer shafts and said filling heads to swivel said filling heads; and said linkage arrangements being slidably carried by said cam shafts to slide as said filling heads reciprocate vertically during engagement and disengagement with said group of containers on said conveyor.

18. The apparatus of claim 17 including cam followers connected to said linkage arrangements, and at least one curved cam carried by a stationary support, and said cam followers engage said cam to swivel said motion to said filling heads.

19. Apparatus for continuously filling empty containers moving on a conveyor with a liquid during a fill operation comprising:

a rotating turret which continuously rotates about a single turret axis during said fill operation;

a plurality of reciprocating filling heads circularly arranged and carried by said rotating turret, and said filling heads rotating about a radial path for alignment and engagement with the containers to fill the containers while the containers are conveyed about an arc of said radial path during said fill operation;

a filling head motion converter operatively associated with said filling heads for causing said filling heads to move generally in a straight-line motion while rotating about said single turret axis at said engagement station to align with and engage said empty containers; and a conveyor for conveying said containers along said arc.

20. The apparatus of claim 19 including an engagement station where said filling heads are lowered to engage empty containers on said conveyor, and a release station where said filling heads are raised to disengage from filled containers on said conveyor; and said filling heads have a fill position between said engagement and release stations wherein said containers are filled during a fill operation.

21. The apparatus of claim 20 wherein said conveyor includes an infeed section and an outfeed section wherein said arc of said radial path is disposed between said infeed and outfeed sections.

22. The apparatus of claim 21 wherein said infeed section includes a generally straight conveyor run for feeding empty containers to said engagement station.

23. The apparatus of claim 21 wherein said outfeed section includes a generally straight conveyor run for conveying filled containers to at least one capping station.

24. The apparatus of claim 23 including a plurality of capping stations disposed along said conveyor for capping filled containers; and said outfeed conveyor section includes a laner assembly for dividing and arranging said filled containers into parallel rows for delivery to selective ones of said capping stations.

25. The apparatus of claim 23 wherein said infeed section, said arc of said radial path, and said outfeed section comprise a single continuous conveyor.

26. The apparatus of claim 21 wherein said arc of said radial path ranges from about 90 to 270 degrees.

27. The apparatus of claim 19 including a rotating reservoir carried atop said rotating turret, and rotating with said turret, for containing a liquid to be dispensed into said containers; and said filling heads including accumulator tanks in fluid communication with said reservoir for receiving liquid to be dispensed into said containers.

28. The apparatus of claim 27 including a group of filling valves carried by said filling heads in fluid communication with said accumulator tank and engaging said containers during filling; and said filling valves having an open position for filling said containers with the liquid and a closed position for blocking liquid flow when the containers are filled.

29. The apparatus of claim 19 wherein said turret includes a plurality of circularly arranged support arms; and said motion converter includes support frames slidably carried by said support arms, said filling heads being carried by said support frames so that said filling heads swivel to maintain said straight-line motion at said engagement station along a prescribed arc of said rotating turret.

30. The apparatus of claim 29 wherein said motion converter includes connector mechanisms associated with said rotating turret and said filling heads for swiveling said heads as they rotate about said turret single axis; and said connector mechanisms include a first linkage arrangement connected near one side of said filling heads and a second linkage arrangement connected near a second side of said filling heads to swivel said heads at said engagement station.

31. The apparatus of claim 29 including a rotating reservoir carried atop said rotating turret, and rotating with said turret, for containing a liquid to be dispensed into said containers; and said filling heads including accumulator tanks in fluid communication with said reservoir for receiving liquid to be dispensed into said containers.

32. The apparatus of claim 19 including a vertical motion mechanism operatively associated with said filling heads for controlling the vertical position of said filling heads between a lowered engaged position where said filling heads engage said containers for filling and a release position where said filling head is raised and disengaged from said containers.

33. The apparatus of claim 32 including a plurality of vertical support arms circularly arranged on said turret generally defining a turret cage surrounding an upstanding support; and said filling heads being slidably carried by said support arms.

34. A continuous circular motion apparatus for processing a group of articles arranged in parallel rows comprising:

a conveyor for conveying a group of articles arranged in parallel rows;

a rotating turret which continuously rotates about a single vertical turret axis;

a plurality of vertically reciprocating processing heads carried by said turret in a circular arrangement, said processing heads rotating along a radial path for continuously and successively engaging said groups of the articles on said conveyor, said processing heads configured for filling the articles; and a processing-head motion converter operatively connected to said processing heads causing said processing heads to move generally in a straight-line along a chordal path while said processing heads rotate about said single turret axis and are lowered to engage said articles.

35. The apparatus of claim 34 wherein said turret includes support arms circularly arranged about said turret; and said motion converter includes:

support frames slidably carried by said support arms, and said processing heads being carried by said support frames so that said processing heads swivel about a swivel axis relative to said support frame as said frames and processing heads rotate about said single turret axis; and connector mechanisms interconnected between said turret and said processing heads for imparting a swivel motion to said processing heads on said frames.

36. The apparatus of claim 35 including a vertical motion mechanism operatively associated with said processing heads for controlling operative vertical positions of said processing heads to engage said articles on said conveyor at an engagement station, and to disengage from said articles on said conveyor at a release station as said turret and processing heads continuously rotate about said single turret axis.

37. The apparatus of claim 34 wherein said conveyor includes an arcuate section having an arc with a curvature generally corresponding to that of said radial path, and a processing operation occurs at least in part along said arcuate section while said processing heads engage said articles.

38. A method of filling containers with a liquid during a filling operation comprising:

providing a plurality of circularly arranged filling heads and continuously rotating the filling heads about a single vertical axis;

feeding containers arranged in groups of parallel single-file rows to an engagement station;

causing the filling heads to sequentially engage said groups of containers at said engagement station for filling the containers;

providing a plurality of filling valves in said filling heads arranged in a pattern corresponding to said group of containers for individually engaging said containers;

causing said filling heads to move along a combination circular and straight line path during engagement of said filling valves and said containers at said engagement station; and filling said containers as the containers are conveyed along an arcuate path about said single axis after engagement with said filling valves.

39. The method of claim 38 including conveying said filled containers in plural single file rows to a plurality of capping stations; and capping said filled containers at said capping stations.

40. The method of claim 38 including providing a reservoir containing fluid to be dispensed into the containers wherein said reservoirs are in fluid communication with said filling heads; and rotating said reservoir about said single axis.

41. The method of claim 38 including conveying said containers on an infeed conveyor section to said engagement station; and conveying said filled containers from said arcuate path to an outfeed conveyor section wherein said infeed conveyor section, arcuate path, and outfeed conveyor section comprise a single continuous conveyor.

42. A method of filling containers with a liquid during a filling operation comprising:

providing a plurality of circularly arranged reciprocating filling heads and continuously rotating the filling heads about a single vertical axis;

feeding containers arranged in at least one row to an engagement station, lowering said filling heads to sequentially engage said containers along said engagement station;

causing said filling heads to move along a substantially horizontal straight line path while rotating about said single axis as said filling heads engage said containers;

filling said containers as the containers are conveyed along an arcuate path about said single axis while said filling heads are rotating about said single axis; and raising said filling heads to disengage from said containers when the containers are filled.

43. The method of claim 42 including arranging an infeed conveyor section and an outfeed conveyor section parallel to one another.

44. The method of claim 43 including arranging a plurality of capping stations along said outfeed conveyor section for receiving and capping said filled containers.

* * * * *

UNITED STATES PATENT AND TRADEMARK OFFICE

CERTIFICATE OF CORRECTION

PATENT NO. : 6,983,577 B2
DATED : January 10, 2006
INVENTOR(S) : Hartness et al.

It is certified that error appears in the above-identified patent and that said Letters Patent is hereby corrected as shown below:

Title page,
Item [56], References Cited, U.S. PATENT DOCUMENTS, add

| | | |
|---|---|---|
| -- 4,053,003 | 10/1977 | Ferrero, et al. |
| 4,655,029 | 04/1987 | Weiss |
| 5,219,405 | 06/1993 | Weiss |
| 5,295,517 | 03/1994 | Ahlers |
| 5,501,253 | 03/1996 | Weiss |
| 5,533,552 | 07/1996 | Ahlers |
| 5,865,225 | 02/1999 | Weiss |
| 5,896,900 | 04/1999 | Haring, et al. |
| 6,026,867 | 02/2000 | Klarl |
| 6,185,910 | 02/2001 | Achhammer |
| 6,354,427 | 03/2002 | Pickel, et al. --. |

Signed and Sealed this

Ninth Day of May, 2006

JON W. DUDAS
*Director of the United States Patent and Trademark Office*